US010881940B1

(12) United States Patent
Ye

(10) Patent No.: US 10,881,940 B1
(45) Date of Patent: Jan. 5, 2021

(54) BELT DRIVING BALL SPORTS TRAINING MACHINE

(71) Applicant: Lurong Ye, Richardson, TX (US)

(72) Inventor: Lurong Ye, Richardson, TX (US)

( * ) Notice: Subject to any disclaimer, the term of this patent is extended or adjusted under 35 U.S.C. 154(b) by 0 days.

(21) Appl. No.: 16/675,103

(22) Filed: Nov. 5, 2019

Related U.S. Application Data

(60) Provisional application No. 62/768,061, filed on Nov. 15, 2018.

(51) Int. Cl.
*A63B 69/40* (2006.01)
*A63B 63/00* (2006.01)

(52) U.S. Cl.
CPC ..... *A63B 69/406* (2013.01); *A63B 2063/001* (2013.01); *A63B 2069/404* (2013.01); *A63B 2069/405* (2013.01)

(58) Field of Classification Search
CPC ..... A63B 2063/001; A63B 69/406
See application file for complete search history.

(56) References Cited

U.S. PATENT DOCUMENTS 3,308,802 A * 3/1967 Applegate ..... A63B 69/406 124/78
3,844,267 A * 10/1974 Mohr ..... A63B 69/40 124/78
4,714,248 A * 12/1987 Koss ..... A63B 47/02 473/436
5,125,653 A * 6/1992 Kovacs ..... A63B 69/406 124/78
5,776,018 A * 7/1998 Simpson ..... A63B 24/0021 473/433
6,224,503 B1 * 5/2001 Joseph ..... A63B 63/083 124/6
6,241,628 B1 * 6/2001 Jenkins ..... A63B 69/0071 473/436
7,927,237 B2 * 4/2011 Jenkins ..... A63B 69/0071 473/433
8,123,634 B1 * 2/2012 Lovett ..... A63B 63/083 473/433
10,561,905 B2 * 2/2020 York ..... A63B 47/002
2016/0325168 A1 * 11/2016 Campbell ..... A63B 69/408

* cited by examiner

*Primary Examiner* — John A Ricci

(57) ABSTRACT

A generic ball sport training machine is described. Propulsion modules containing belts are used to sequentially launch balls to replicate the result of an athlete's action. When a ball enters the launch corridor created by one or more propulsion modules, the belts accelerate it to a desired speed, spin magnitude and spin direction. These propulsion modules are assembled in various combinations and integrated with an advanced ball feeder/collection assembly, plus elevation and azimuth direction control, to create a complete functional machine.

8 Claims, 13 Drawing Sheets

BELT DRIVING BALL SPORTS TRAINING MACHINE

TECHNICAL FIELD

This disclosure describes a machine for the efficient ball sports training of athletes. More specifically, this disclosure describes a machine that launches balls using a set of modular conveyor belts. The machine using this salient design can be manufactured to accommodate, for example, volleyballs, table tennis balls, tennis balls, baseballs and soccer balls.

BACKGROUND OF THE INVENTION

Referring to products currently on the market and those disclosed in patent filings, ball training machines are mainly for volleyball, table tennis and tennis. Among these three types of ball training machines, the volleyball machine appears with the largest number of operating principle variations. The following paragraphs compare and contrast the operating principles of existing and previously disclosed volleyball training machines.

The existing volleyball training machines and disclosed ideas are lacking in practical capabilities and other aspects. Essentially, they are merely ball launching devices. They are unable to simulate volleyball game tactical maneuvers, such as "the second pass", nor mimic of "the smasher". Moreover, these machines are heavy and bulky; so that carrying, field installation, and adjustment are difficult. AC main power cords are necessary. Such limitations restrict these machines to indoor gymnastics, thus neglecting or restricting important beach and other outdoor applications.

Operating principles of volleyball launch equipment disclosed in patent filings as opposed to existing commercial products can be classified to the following categories. 1) A spring or leaf spring is used to launch the ball by first stretching or compressing it and then suddenly releasing it to strike the ball. 2) Compressed air is suddenly released to strike the ball. 3) Compressed air is suddenly released into a cylinder whose piston strikes the ball. 4) A hydraulic cylinder pushes its piston which then strikes the ball. 5) A motor-driven cam pushes a pushrod to strike the ball. 6) A motor rotates and accelerates a pendulum, and the other end of the pendulum strikes the ball. 7) The ball is ejected after going through two or more side-by-side high speed spinning friction wheels.

The disadvantage of item 1) is: The helical (solenoid) spring, and the leaf spring assemblies have considerable inertia. Immediately after collision with the ball, the spring assembly's kinetic energy is still at a high level. When the assembly reaches its fiduciary position, ready for the next ejection cycle to begin, the energy is zero. In this process, most of the energy is wasted in the form of noise and heat. Also, impact with the ball makes a loud booming sound that is unpleasant to the users, especially indoors.

For the compressed air and hydraulic driven machines shown in items 2) through 4), an air pump or hydraulic pump is needed, both of which are expensive, heavy and bulky. Also, sudden release of compressed air causes loud sound, which is uncomfortable for indoor applications. As for the hydraulic implementation, motion of the piston is usually much slower than that of compressed air release or electric motor drive, unless a very high powered pump is employed; therefore, the piston cannot accumulate enough speed in a short time to adequately launch the ball. If the extra-large pump is necessary, the machine's total weight and cost will be prohibitive for the intended market.

The disadvantage of 5) and 6) is: The motor is initially motionless. When the machine is ready to launch a ball, the motor begins rotation to drive an actuating arm until it strikes the ball. Owing to the actuating arm's large inertia, a high capacity motor and large instantaneous power are needed to accelerate it to the necessary speed within the allowed time.

Items 2) through 6) have the same additional problem as Item 1). The motion for each implementation is to-and-fro. After striking the ball, the moving parts' energy must be returned to zero and for return to the fiduciary position. During this operational step of the operating process, much energy is wasted in the form of sound, heat, and other losses. Moreover, none of the methods described in items 1) through 6) permit precision control of ball spin.

Of all the methods described, item 7) is most commonly found in the marketplace. It is relatively safe, quiet, power-efficient, and allows precision control of ejected ball spin. The disadvantage of this method is that the time the ball takes to pass through the friction wheels is very short. In order to accelerate the ball to the necessary speed in such a short time requires two or three high power motors for the larger balls (usually two or three 1 HP motors). In addition, the friction between the wheels and ball prematurely wears out the ball surface.

BRIEF SUMMARY OF THE INVENTION

This invention, a training machine to facilitate the practice of a ball sport, uses a belt or belts as the propulsion means to launch a ball. When the ball enters the input port of a launch corridor, the belt or belts will grip and drag the ball and accelerate it to the necessary pre-programmed speed and spin magnitude and eject it from the output port. In addition to the Launcher Assembly, the ball sports training machine includes the Ball Feeder Assembly, the Ball Collection Assembly, the elevation angle adjustment and the horizontal (azimuth) direction adjustment mechanisms.

As additional detail, this Belt-Driven Ball Sports Training Machine consists of a Launcher Assembly, a Launcher Assembly Stand, a Machine Platform, a Ball Feeder Assembly and a Ball Collection Assembly. The Launcher Assembly is mounted on the Launcher Assembly Stand. The Launcher Assembly Stand is mounted on the Machine Platform. The Ball Feeder Assembly is mounted above the Launcher Assembly and is connected to the Launcher Assembly Stand. The Ball Collection Assembly is on the top of the Ball Feeder Assembly.

The Launcher Assembly is composed of belt propulsion modules. There are two types of belt propulsion modules, referred to as the belt-driven propulsion module and the tension belt-driven propulsion module. Various module combinations make various Launcher Assembly types. These two types of modules are the fundamental modular components in the machine. All these propulsion modules are independently controllable and can be distributed in three dimensions to create various Launcher Assembly types.

The ball feeding timing interval control is achieved by using a simple motor having unidirectional speed. A single motor operates the ball release mechanism at the bottom of the bottom of the Feeder Assembly while simultaneously driving the antijamming function in the Ball Collection Assembly.

A unique interlinkage arrangement between the Ball Feeder Assembly and the Launcher Assembly is made to ensure that the Ball Feeder Assembly releases one ball at a time and that its exit is always in the correct position to feed the Launcher Assembly.

The benefits of this invention are: The belt-driven mechanism effectively solves the problems of loud noise, large size, heavy weight, unwanted machine motion, low efficiency, high cost and safety risk. Moreover, the belt propulsion module's modular structure permits the machine to achieve multiple functions within the launch corridor: 1) feeding a ball to the ball launch position, 2) controlling the launch direction, 3) launch speed and 4) spin direction and magnitude. Launch repeatability, reliability and overall effectiveness are enhanced versus existing equipment. The restriction of the ball uniformity is much relaxed.

BRIEF DESCRIPTION OF THE FIGURES

The detailed description of the invention is based on the following figures and the embodiments.

In the figures.

1. Launcher Assembly
2. Launcher Assembly Stand
3. Machine Platform
4. Ball
5. Launch Corridor
6. Main Drive Wheel
7. Small Pulley
8. Belt
9. Large Pulley
10. Driving Motor
11. Belt-Driven Module Bracket
12. Tension Pulley
13. Wheel Driving Module
14. Belt-Driven Propulsion Module
15. Single Belt-Driven Module Support
16. Ball Guiding Manifold
17. Single Belt-Driven Launcher Assembly
18. Double Belt-Driven Launcher Assembly
19. Triple Belt-Driven Launcher Assembly
20. Tension Belt-Driven Propulsion Module
21. Timing Control Motor
22. Rotating Disk
23. Pushrod
24. Arc Slide Track
25. Stop-Go Slider
26. Slave Rod
27. Guide Ring
28. Chassis Support
29. Turntable
30. Turntable Motor
31. Angle Adjustment Motor
32. Next Ball
33. Ball Feeder Duct
34. Assembly Binding Body
35. Ball Entrance Duct
36. Funnel
37. Circular Frame Structure
38. Eccentric Shaft
39. Ball Feeder Assembly
40. Ball Collection Assembly
41. Ball Feeder Hinged Plate
42. Ball Feeder Duct Fixed Ring
43. Hinge Joint
44. Fixture
45. Spherical Bearing
46. Ganged Push Rod
47. Stop-Go Arc

DETAILED DESCRIPTION OF THE EMBODIMENTS

Note: For the sake of convenience and simplicity, except specified, "propulsion module" is the generic phrase for the "Belt-Driven Propulsion Module", "Tension Belt-Driven Propulsion Module" and "Wheel Driving Module". The "launch corridor" is the generic phrase for all the launch corridors formed by embodiment 1, 2 and 3 based on the "propulsion modules".

This invention uses a belt or belts as the propulsion means to launch a ball. When the ball enters the input port of launcher assembly corridor, the belt or belts grip and drag the ball and accelerate it to the necessary pre-programmed speed and spin magnitude and eject it from the output port.

Figure 1:
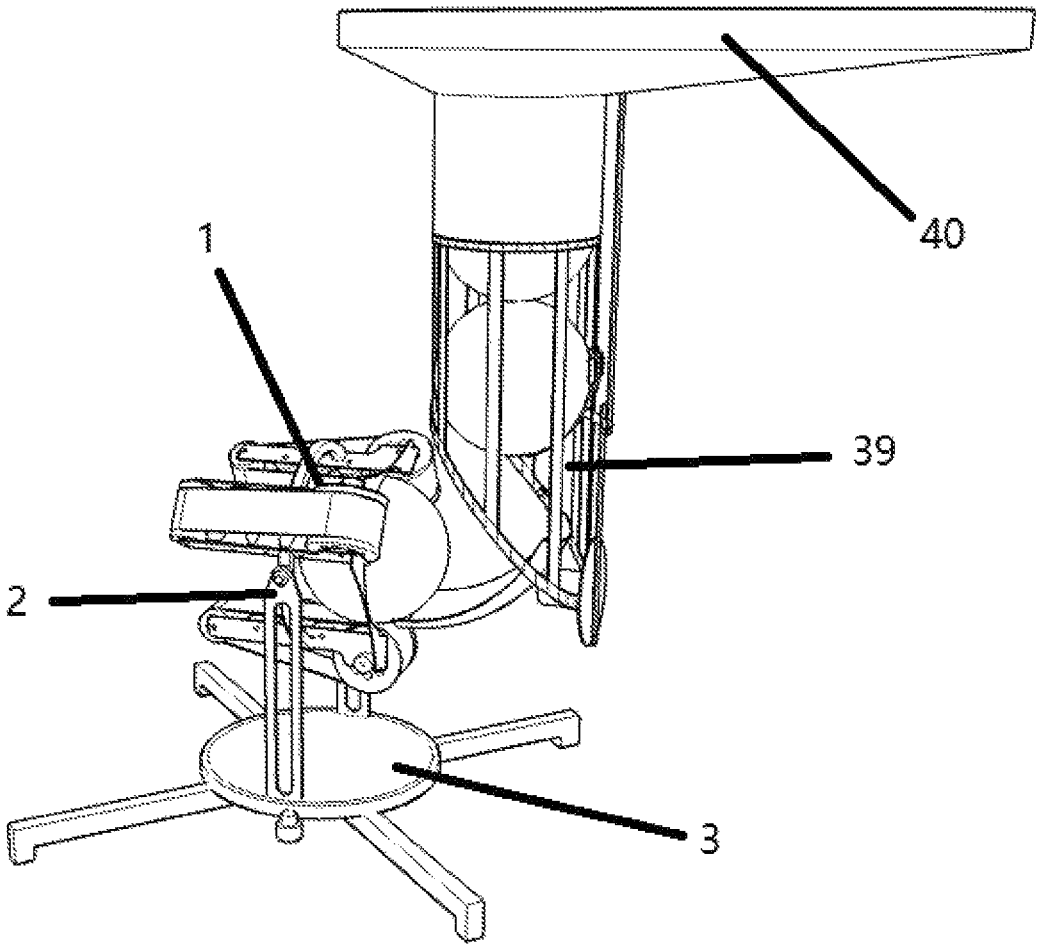
FIG. 1 shows the structure of the machine based on the Launcher Assembly, the Ball Feeder Assembly, the Ball Collection Assembly, the Launcher Assembly Stand and the Machine Platform. This figure shows the Launcher Assembly based on the embodiment 2.

As additional detail, as shown in FIG. 1, this machine consists of a Launcher Assembly 1, a Launcher Assembly Stand 2, a Machine Platform 3, a Ball Feeder Assembly 39 and a Ball Collection Assembly 40. The Launcher Assembly 1 is also mounted on the Launcher Assembly Stand 2. The Launcher Assembly Stand 2 is mounted on the Machine Platform 3. The Ball Feeder Assembly 39 is mounted above the Launcher Assembly 1 and is connected to the Launcher Assembly Stand 2. The Ball Collection Assembly 40 is on the top of the Ball Feeder Assembly 39.

The Launcher Assembly 1 is composed of belt-driven propulsion modules. There are two types of belt-driven propulsion modules, referred to as Belt-Driven Propulsion Module 14 and Tension Belt-Driven Propulsion Module 20. Different module combinations create different Launcher Assembly 1. These two types of modules are the fundamental modular components in the machine.

Figure 3:
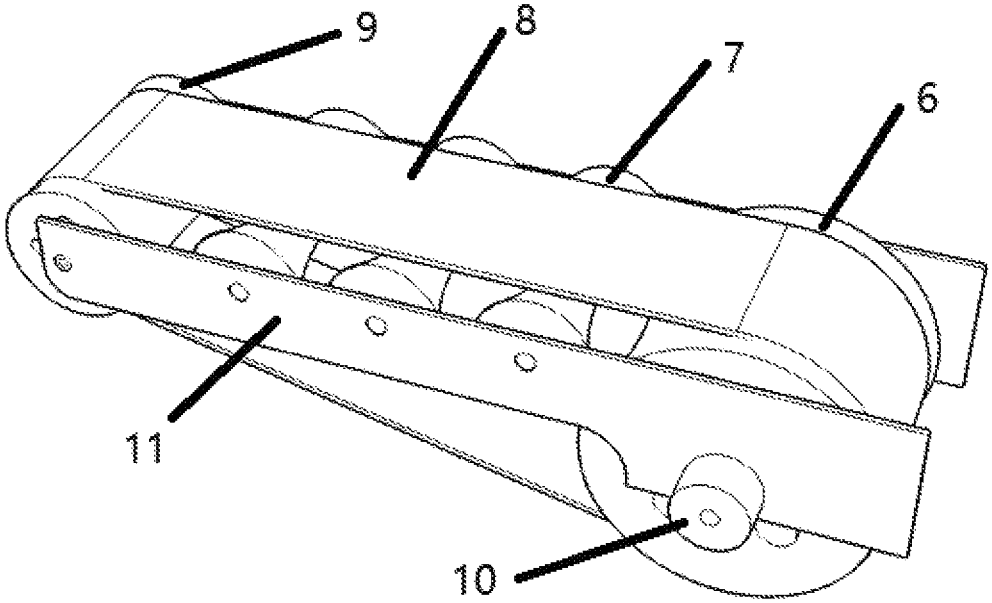
FIG. 3 shows the structure of the Belt-Driven Propulsion Module.

As shown in FIG. 3, the Belt-Driven Propulsion Module 14 comprises the Driving Motor 10, the Main Drive Wheel 6, the Large Pulley 9, the Small Pulley 7 and a Belt 8. The Driving Motor 10 will drive the Main Drive Wheel 6, and in sequence drive the Belt 8, the Large Pulley 9 and the Small Pulley 7. Eventually the Belt 8 will drag the Ball 4 to move. The cylinder surfaces of the Main Drive Wheel 6, the Large Pulley 9 and the Small Pulley 7 are a circular arc shape which matches to the ball's surface arc. This shape helps to enlarge the contact surface between the belts and the ball and increase the friction between them.

Figure 4:
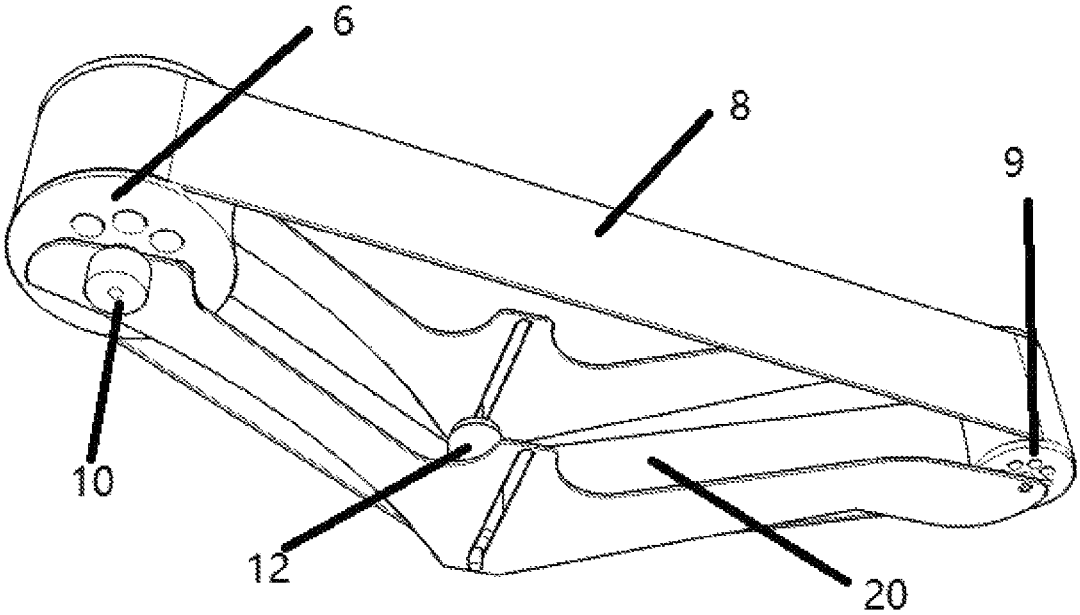
FIG. 4 shows the structure of the Tension Belt-Driven Propulsion Module.
Figure 5:
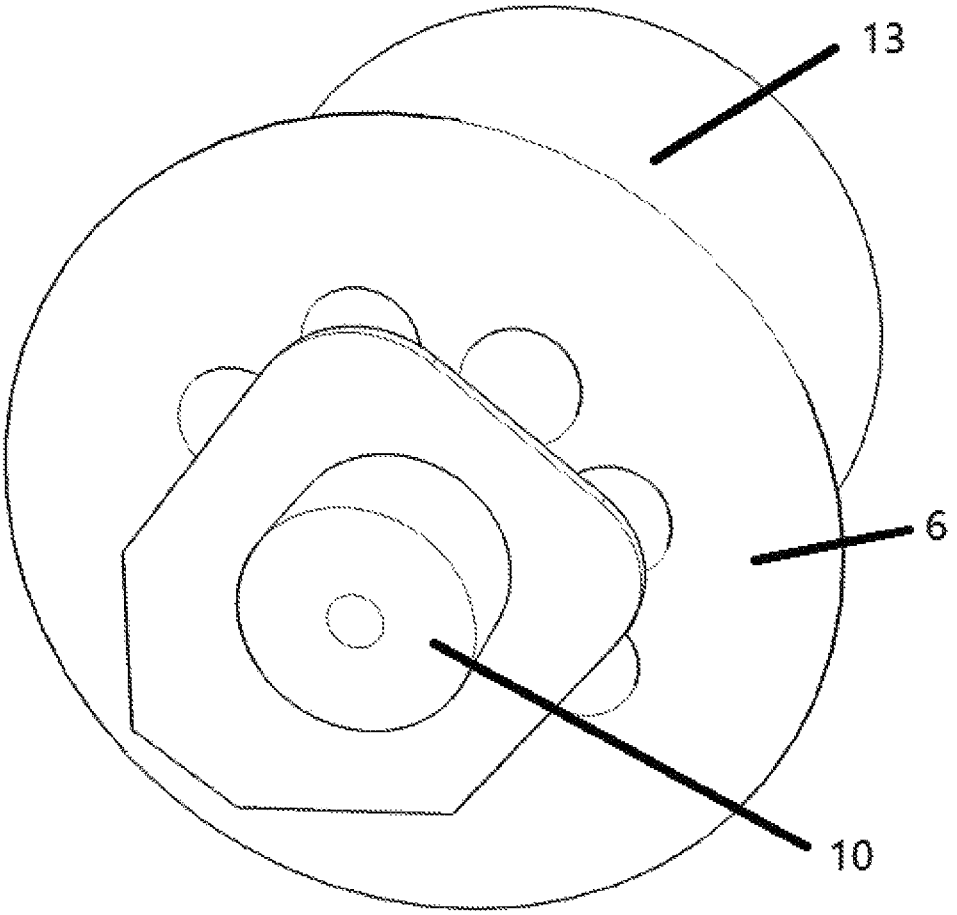
FIG. 5 shows the structure of the Wheel Driving Module.

As shown in FIG. 4, the Tension Belt-Driven Propulsion Module 20 comprises the Driving Motor 10, the Main Drive Wheel 6, the Large Pulley 9, the Tension Pulley 12 and the Belt 8. The Tension Belt-Driven Propulsion Module 20 works with a Wheel Driving Module 13. As shown in FIG. 5 the Wheel Driving Module 13 consists of the Driving Motor 10 and the Main Drive Wheel 6. The Driving Motor 10 in the Tension Belt-Driven Propulsion Module 20 drives the Main Drive Wheel 6 and then drives the Belt 8, the Large Pulley 9 and eventually drive the Ball 4. Meantime, the Driving Motor 10 in the Wheel Driving Module 13 will drive the Main Drive Wheel 6 and work with the Belt 8 to drag the ball moving along the launch corridor. The curved surfaces of the Main Drive Wheel 6, and the Large Pulley 9 are shaped with a circular arc which matches the ball's curvature. This shape helps to enlarge the contact surface between the belts/wheel and the ball and increase the friction between them.

As shown in FIG. 3, the Belt-Driven Propulsion Module 14 is built by assembling the Main Drive Wheel 6, the Small Pulley 7, the Large Pulley 9 and the Driving Motor 10 on the Belt-Driven Module Bracket 11 and finally installing the Belt 8. The Belt-Driven Propulsion Module 14 has been built.

As shown in FIG. 4, the Tension Belt-Driven Propulsion Module 20 is built by assembling the Main Drive Wheel 6, the Large Pulley 9, the Tension Pulley 12 and the Driving Motor 10 on the propulsion module's support and finally mounting the Belt 8. The Tension Pulley 12 tightens the Belt 8 all the time. So, its default position is at the down position which forces the top portion of the belt straight.

Figure 2:
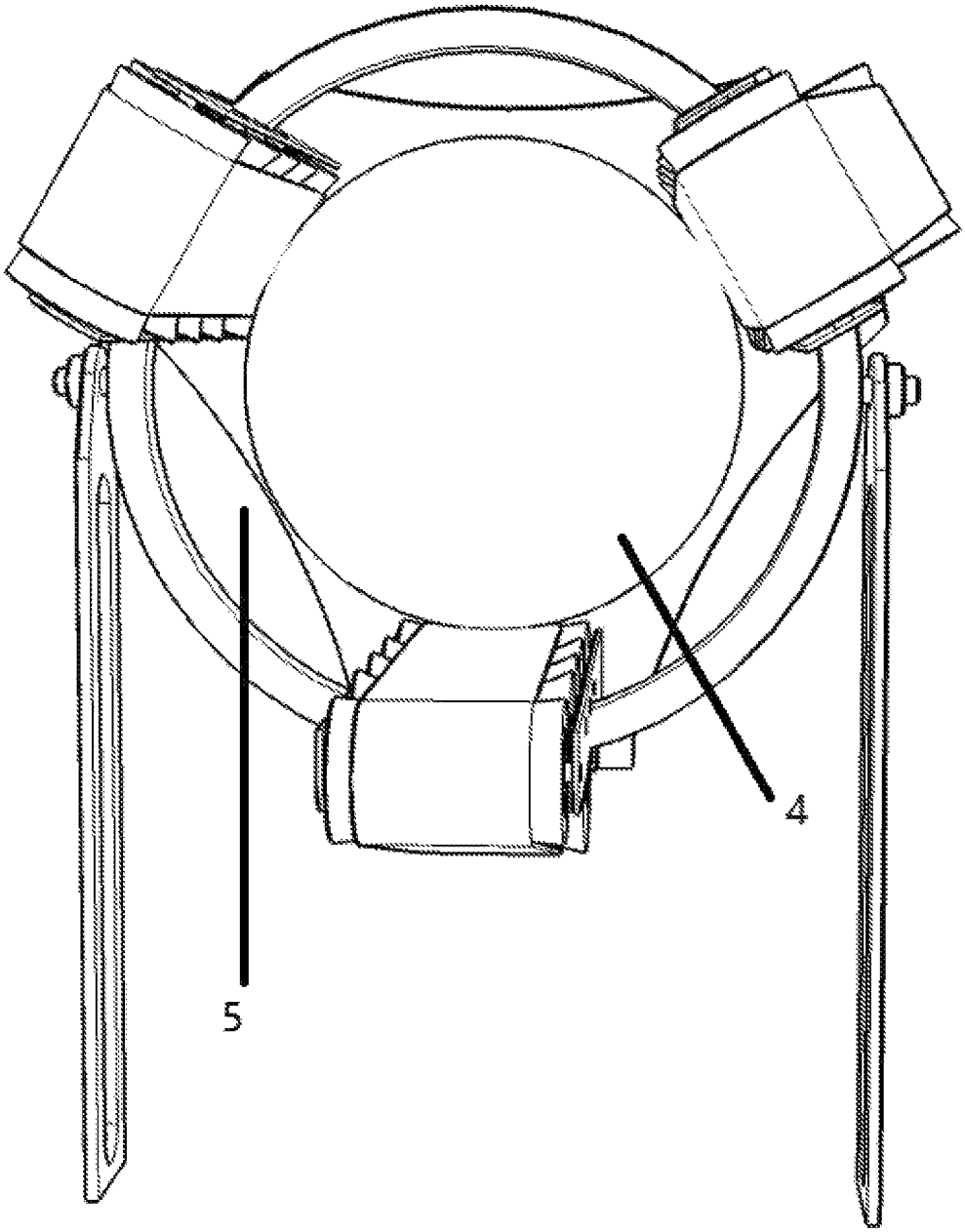
FIG. 2 shows the Launch Corridor in the Triple Belt-Driven Launcher Assembly.

The Launcher Assembly 1 uses belt-driven propulsion module and tension belt-driven propulsion module described above to form the different Launcher Assemblies 1 with different specialties. There are one or more than one propulsion modules distributed along a circle to form a Launch Corridor 5 as shown in FIG. 2. The Launch Corridor's 5 diameter is slightly smaller than the diameter of the ball. In addition, the diameter at the entry is slightly different from it at the exit of the corridor. It looks like a bell mouth shape.

Figure 6:
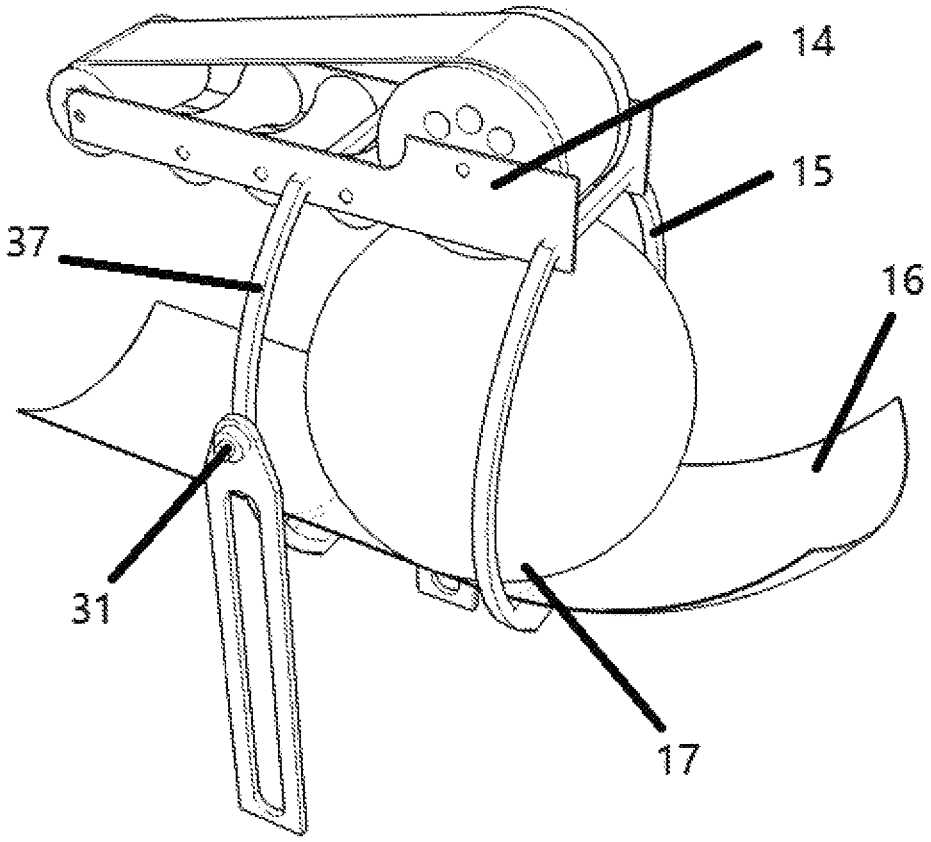
FIG. 6 shows the Launcher Assembly using a single Belt-Driven Propulsion Module.

The Launcher Assembly 1 is built up by following three embodiments:

Embodiment 1: Belt-Driven Propulsion Module 14+Ball Guiding Manifold 16. As shown in FIG. 6.

Figure 7:
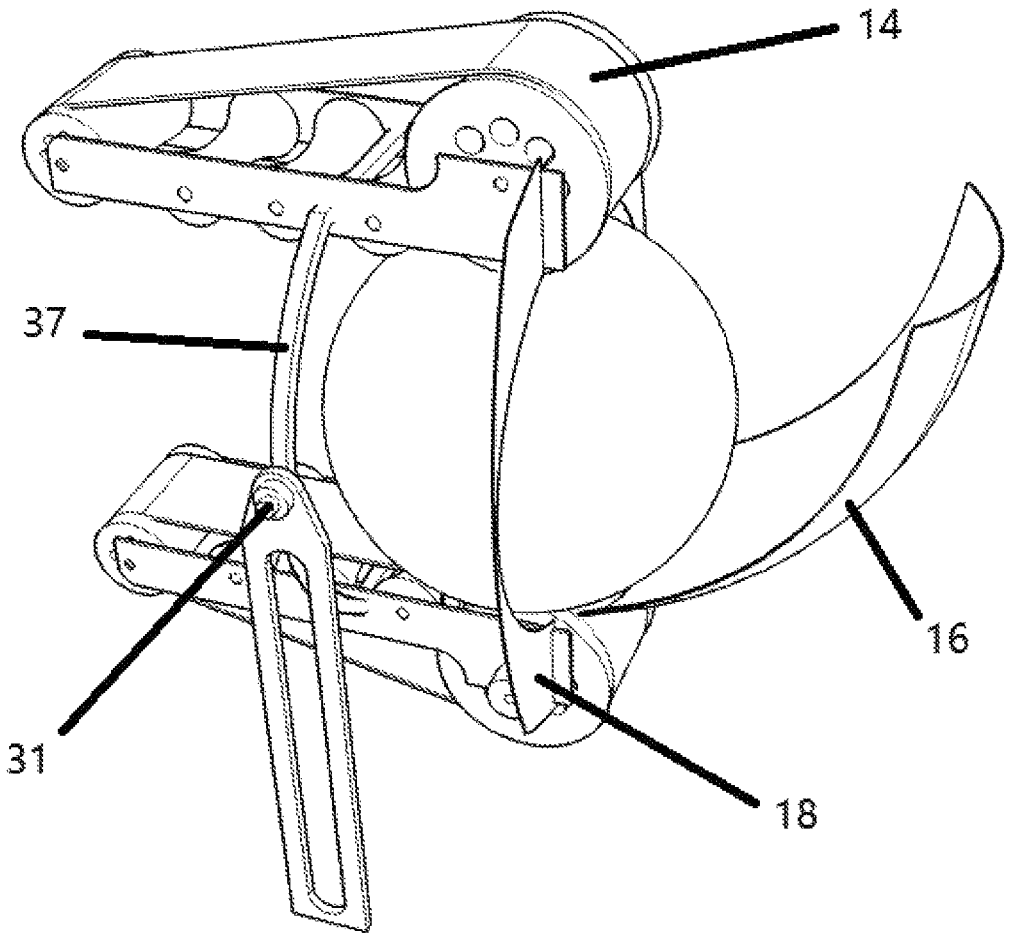
FIG. 7 shows the Launcher Assembly using two Belt-Driven Propulsion Modules.
Figure 8:
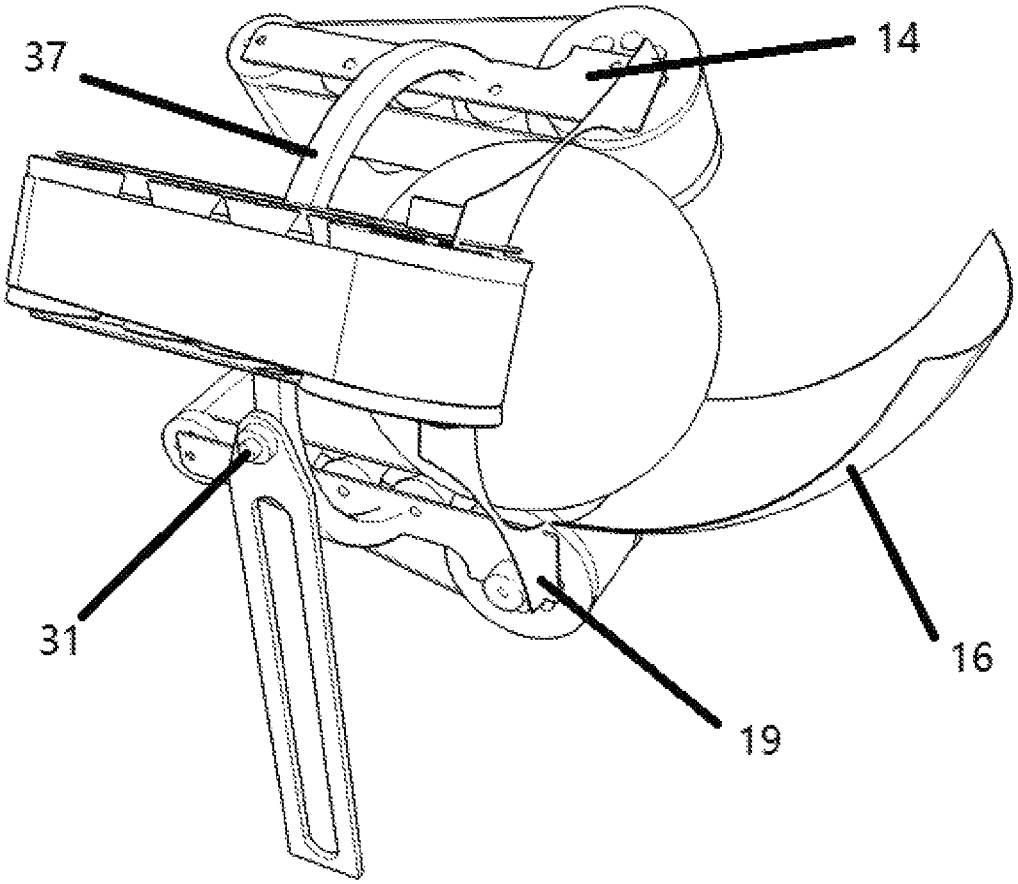
FIG. 8 shows the Launcher Assembly using three Belt-Driven Propulsion Modules.

Embodiment 2: Belt-Driven Propulsion Module 14+one or two same modules. As shown in FIGS. 7 and 8.

Figure 9:
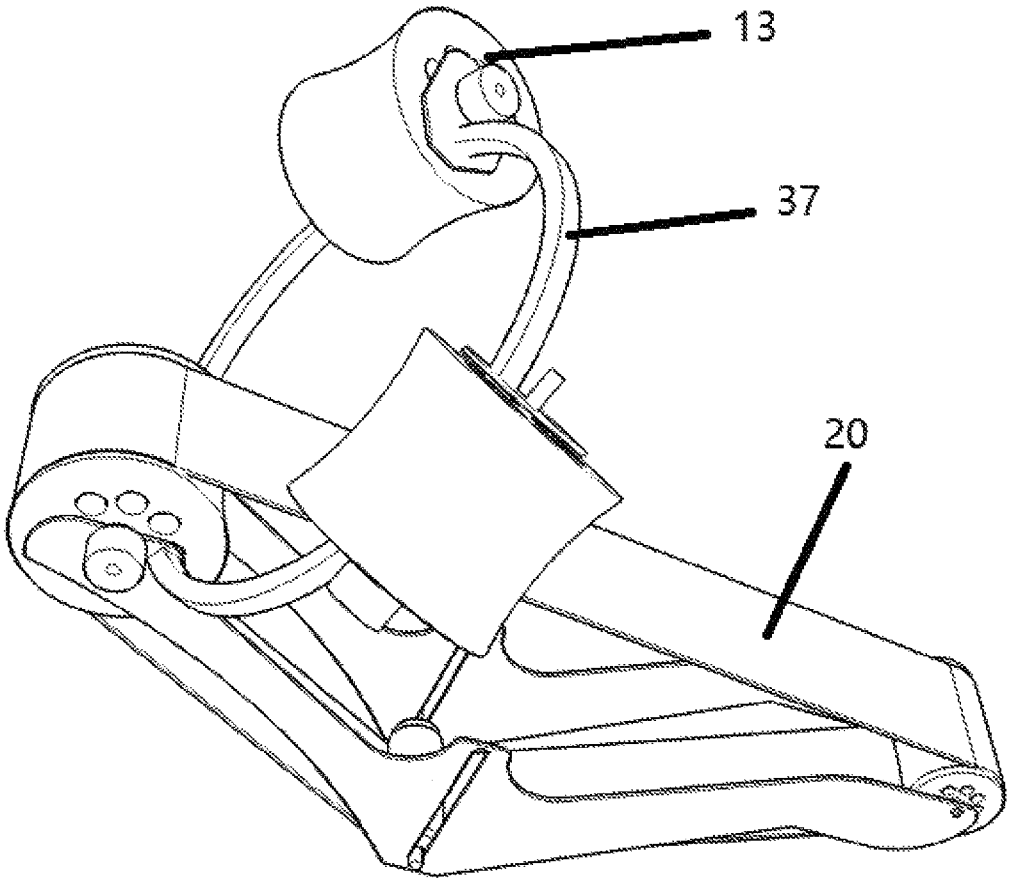
FIG. 9 shows the Launcher Assembly formed by one Tension Belt-Driven Propulsion Module and two Wheel Driving Modules.

Embodiment 3: Tension Belt Driven Propulsion Module 20+one or two Wheel Driving Modules 13. As shown in FIG. 9.

Following are different implementations for the Launcher Assembly 1 based on the three embodiments mentioned above.

As shown in FIG. 6, the Single Belt-Driven Launcher Assembly 17 described in the embodiment 1 is assembled by, on the launcher assembly base, mounting a Belt-Driven Propulsion Module 14, the Single Belt-Driven Module Support 15, the Ball Guiding Manifold 16 and the Fine Tuning Frame 37 to form a launcher assembly.

As shown in FIG. 7, the Double Belt-Driven Launcher Assembly 18 described in embodiment 2 is assembled by, on the launcher assembly base, mounting two Belt-Driven Propulsion Modules 14, the Ball Guiding Manifold 16 and the Fine Tuning Frame 37 to form a launcher assembly.

As shown in FIG. 8, the Triple Belt-Driven Launcher Assembly 19 described in embodiment 2 is assembled by, on the Launcher Assembly 1 base, mounting three Belt-Driven Propulsion Modules 14, the Ball Guiding Manifold 16 and the Fine Tuning Frame 37 to form a Launcher Assembly 1.

As shown in FIG. 9, a Tension Belt-Driven Launcher Assembly is assembled by, on the Circular Frame Structure 37, mounting a Tension Belt-Driven Propulsion Module 20 and one or two Wheel Driving Module 13 to form a launcher assembly described in the embodiment 3. In this figure two Wheel Driving Modules 13 are used. The launcher assembly with one Wheel Driving Module 13 (not shown) is very similar to this embodiment. The only difference is the module distribution along the Circular Frame Structure 37. The single Wheel Driving Module 13 is mounted just on the top of the Tension Belt-Driven Propulsion Module 20. Two Wheel Driving Modules 13 are evenly distributed on the Circular Frame Structure 37 with the Tension Belt-Driven Propulsion Module 20, as shown in FIG. 9.

All the embodiments disclosed above are based on the same principle in which there are one or more than one high speed means such as a belt(s) to grip and drag the ball to move forward. The selection of the embodiment depends on the ball's mass, size and the desired speed and spin magnitude. Among them, embodiment 2 and 3 can control the ball's speed, spin direction and spin magnitude at the same time by setting different speed on each propulsion module.

In the embodiment 1 and 2, when every Belt-Driven Propulsion Module 14 spins, as soon as the Ball 4 enters the Launch Corridor 5 through the Ball Guiding Manifold 16, each Belt-Driven Propulsion Module 14 will slightly squeeze and strongly drag the ball moving forward.

In the embodiment 3, as soon as the Ball 4 enters the launch corridor through the Ball Guiding Manifold 16, the trapping of the Ball 4 between the Wheel Driving Module 13 and the Belt 8 bends the top portion of the Belt 8 downward which will force the Tension Pulley 12 shift up to compensate the belt's bending. With the help of the tension, the top bending belt will partially enclose the ball against the Wheel Driving Module 13 which will compress the ball slightly and make a good contact with the ball, and drag the ball moving forward. In this process, the launch corridor is formed along the circum-circle of the Main Drive Wheel 6 on the Wheel Driving Module 13.

The launch corridor formed by embodiment 1 and 2 is different from that formed by embodiment 3. The launch corridor formed by embodiment 1 and 2 is a straight line. The launch direction is the same axis direction of the launch corridor. However, the launch corridor formed by the embodiment 3 is an arc circling along the Main Drive Wheel 6 of the Wheel Driving Module 13. The launch direction follows the direction of the normal line of the exit plane formed by the Tension Belt-Driven Propulsion Module 20 and the Wheel Driving Module(s) 13.

In all above 3 embodiments, the Ball 4 gets its momentum by use of the friction between the Ball 4 and the Belt 8 and the travelling time/distance in the launch corridor. Stronger the friction, more is the driving force to the Ball 4. However, if the friction is too strong, the efficiency of the energy transfer from the Belt 8 to the Ball 4 will be decreased. As shown in FIGS. 3,4 and 5, the cylinder surface of the Main Drive Wheel 6, the Large Pulley 9 and the Small Pulley 7 is a circular arc. And their curvature decreases along the path of the corridor. So, when the Ball 4 enters the launch corridor, the contact between the Ball 4 and the Belt 8 is not a point-contact, but a surface-contact due to the circular arcs and the bending of the Belt 8. Therefore, the friction between them is effectively increased. In embodiment 1 and 2, the friction can be adjusted by a): changing the curvature, and/or by b): adjusting the diameter of the Launch Corridor 5 on both the entrance and the exit by turning the Circular Frame Structure 37, and/or by c): adjusting the softness of the Belt 8. In embodiment 3, bedside the means mentioned above, the friction can also be adjusted by adjusting the tension spring on the Tension Pulley 12, which is more direct and effective.

FIG. 2 shows the Launch Corridor 5 formed by three Belt-Driven Propulsion Modules 14 for the description. All kinds of er Assemblies 1 created by three different embodiments will form the same conceptual and functional launch corridor.

The Driving Motor 10 is the basic driving component for all type of propulsion modules. Each Driving Motor 10 has an individual control circuit to control its speed. When the motors spin, all belts and driving wheels on the propulsion modules will move forward in the same direction. As soon as the setting speed of all Driving Motor 10 are reached, the machine is in READY TO LAUNCH status.

Entering the launch corridor and dragged by the propulsion modules, the ball moves along the launch corridor and exits at its end. In this process, the ball has been accelerated. When the ball reaches the end of the launch corridor, it gets its maximum speed. Then it is launched along the launch corridor's axis.

In all type of er assemblies disclosed in this description, the propulsion modules are distributed along a circle to form the launcher corridor. All propulsion modules work together. On purposely each module's speed can be set at different levels. When a ball gets its acceleration in the launcher corridor, it also gets spin in addition to the forward momentum. At the end of the launch corridor, the ball will be launched with a spin. Different spin direction and spin magnitude in 360 degree, such as top spin, float spin and side spins, can be achieved by arranging the different speeds among the propulsion modules.

Figure 10:
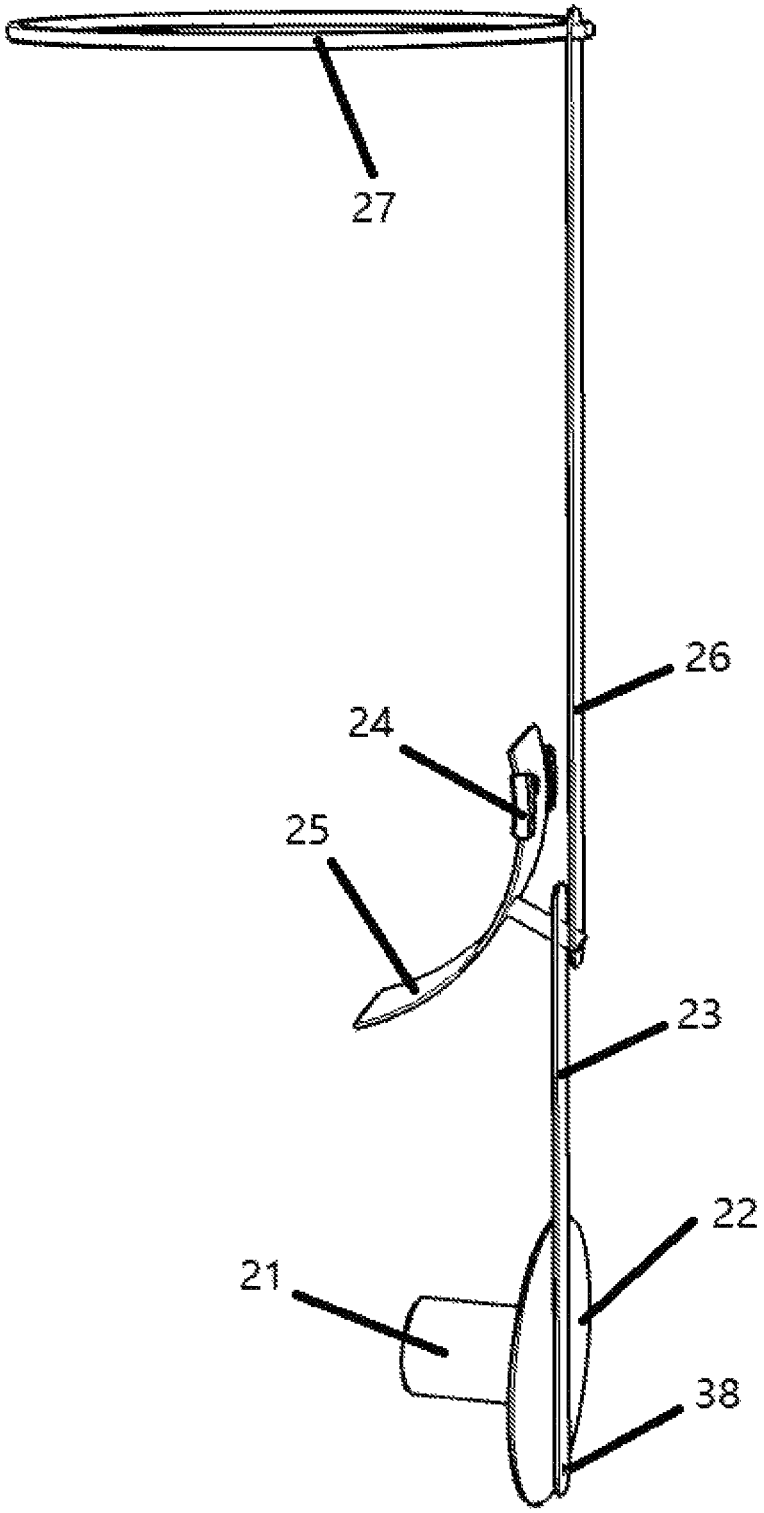
FIG. 10 shows the structure performing ball delivery from the Feeder, and ball jam prevention at the entry of the Ball Entrance Duct.
Figure 11:
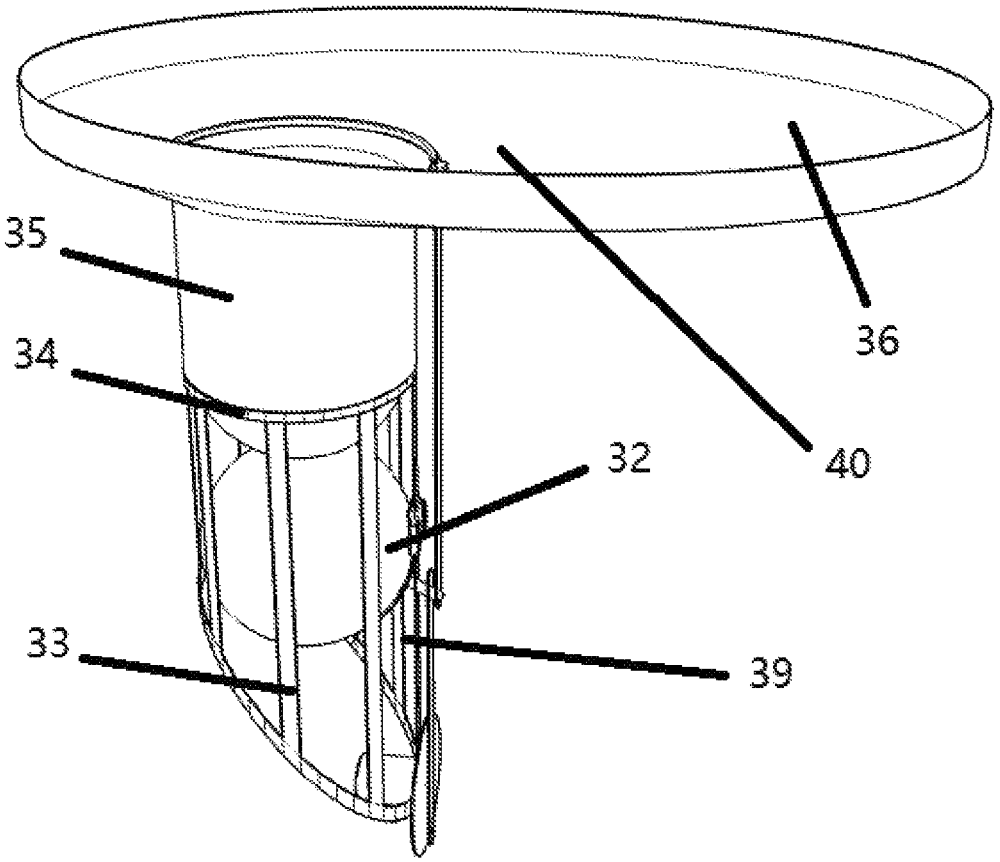
FIG. 11 shows the implementation of FIG. 10 in the machine.

The Ball Feeder Assembly 39 and the Ball Collection Assembly 40 are shown in FIGS. 10 and 11. The Ball Feeder Assembly 39 consists of the Timing Control Motor 21, the Rotating Disk 22, the Pushrod 23, the Arc Slide Track 24, the Stop-Go Slider 25, the Ball Feeder Duct 33, the Assembly Binding Body 34 and the Eccentric Shaft 38. The Ball Collection Assembly 40 consists of the Slave Rod 26, the Guide Ring 27, the Ball Entrance Duct 35 and the Funnel 36. The diameter of the Guide Ring 27 is larger than 1 time but less than 1.5 times of the ball diameter.

Figure 13:
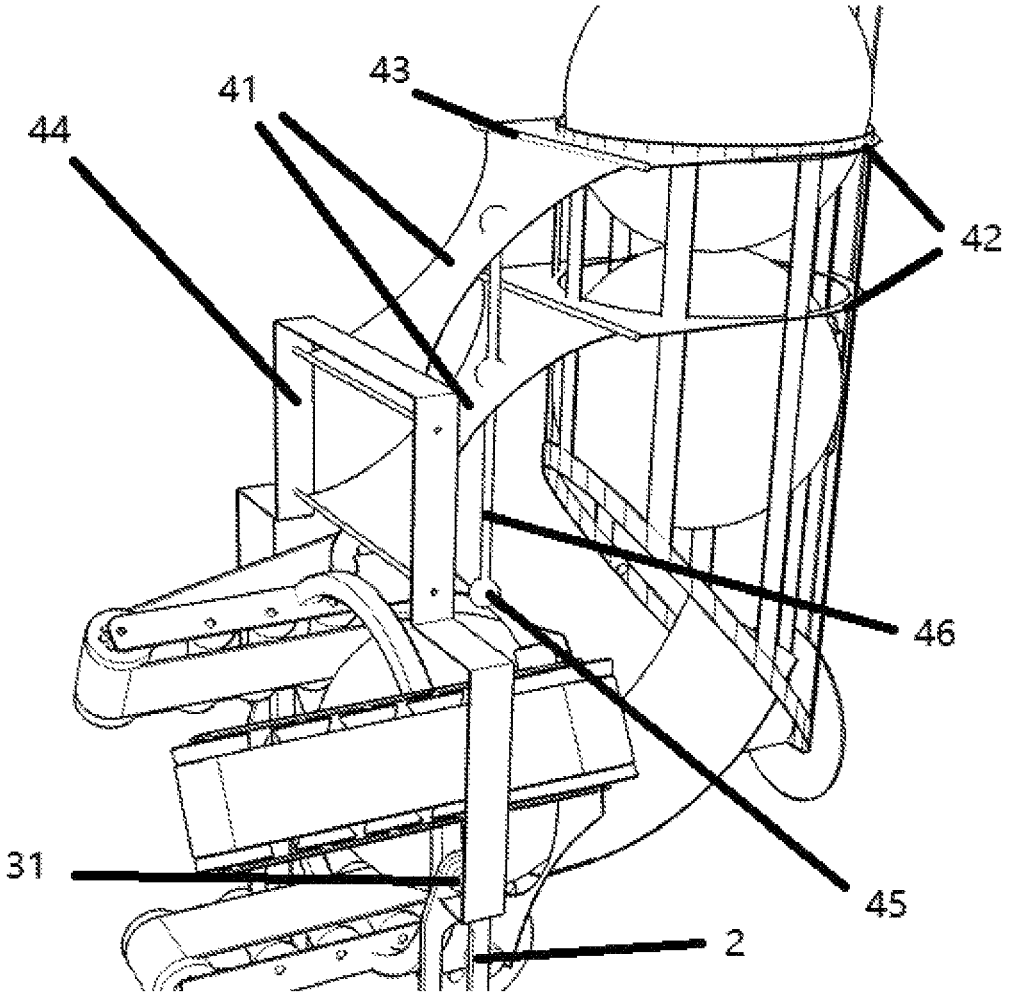
FIG. 13 shows the interlinkage structure between the Ball Feeder Assembly and the Launcher Assembly.

FIG. 13 shows the Ball 4 dropped from the Ball Feeder Assembly 39 to the Launcher Assembly 1. Since the Launcher Assembly 1 will change the vertical launch angle during the operation through the Angle Adjustment Motor 31, the entry position of the Launcher Assembly 1 changes dynamically related to the Launcher Assembly Stand 2. To make the Ball 4 to enter the launch corridor smoothly, following interlinkage is arranged. There is the Fixture 44 on the Launcher Assembly Stand 2. The Ball Feeder Duct 33 and two Ball Feeder Duct Fixed Ring 42 are connected as one entity. Two Ball Feeder Duct Fixed Ring 42 and two Ball Feeder Hinged Plates 41 are connected through the Hinge Joints 43. In this way, the motion of the Ball Feeder Duct 33 will be determined by two Ball Feeder Hinged Plates 41. The linkage movement between the two Ball Feeder Hinged Plates 41 guarantees that the Ball Feeder Duct 33 is always vertical upward in any position so that the ball will drop by the gravity. The Launcher Assembly 1 and the two Ball Feeder Hinged Plates 41 are connected through the Spherical Bearing 45 and the Ganged Push Rod 46. So, the Ball Feeder Duct 33 exit is always right in feeding position to the entrance of the Launcher Assembly 1 which ensures the Ball 4 will enter the launch corridor smoothly. Note: As soon as it enters the space between the Ball Guiding Manifold 16 and the Main Drive Wheel 6, because of the rotation of the Main Drive Wheel 6, the Ball 4 is dragged into the launch corridor by the Main Drive Wheel 6.

The Ball Feeder Assembly 39 and the Ball Collection Assembly 40 is assembled is assembled as following. Assemble the Timing Control Motor 21 and the Arc Slide Track 24 on the Ball Feeder Duct 33. Install the Guide Ring 27 in the Funnel 36. Then assemble the Ball Entrance Duct 35 under the Funnel 36 with the Ball Feeder Duct 33 through the Assembly Binding Body 34. This collapsible design of the Ball Feeder Assembly 39 and the Ball Collection Assembly 40 is for the convenience of field assembling. The Ball Collection Assembly 40 can be an option of the product.

As shown on FIG. 10, the timing interval control means and the antijamming mechanism are assembled as following. Mount the Rotating Disk 22 on the Timing Control Motor 21. Assemble the Stop-Go Slider 25 in the Arc Slide Track 24. Assemble the Pushrod 23 between the Rotating Disk 22 and the Stop-Go Slider 25. Connect the Pushrod 23 to the Rotating Disk 22 through the Eccentric Shaft 38. Connect the Slave Rod 26 between the Stop-Go Slider 25 and the Guide Ring 27. The Ball Feeder Assembly 39 and the Ball Collection Assembly 40 shown in the FIG. 11 will eventually be mounted above entrance of the Launch Corridor 5 as shown in FIG. 1.

The ball feeding timing interval is controlled by controlling the Timing Control Motor's 21 speed. Every rotation cycle of the Timing Control Motor 21 will move the Pushrod 23 up and down once through the Rotating Disk 22. The Pushrod 23 will in turn move the Stop-Go Slider 25 up and down once in the Arc Slide Track 24. In every cycle one, and only one, ball will drop into the launch corridor through the Ball Guiding Manifold 16.

When the Stop-Go Slider 25 is in its down position, the Next Ball 32 is blocked. When the Stop-Go Slider 25 is in its up position, the Next Ball 32 will drop into the Launch Corridor 5 through the Ball Guiding Manifold 16. But the other balls above the Next Ball 32 will be blocked by the Stop-Go Slider 25.

Figure 14:
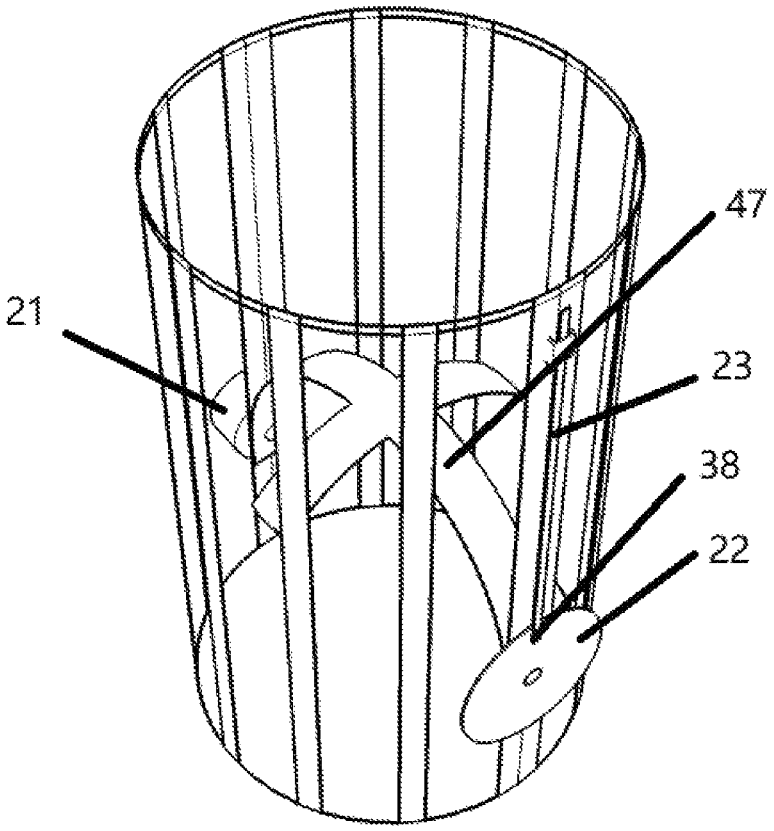
FIG. 14 shows another structure performing the ball feeding control.

In another embodiment for the timing interval control shown in FIG. 14, the timing is controlled by the speed of the Timing Control Motor 21 same as mentioned above. The Timing Control Motor 21 directly drives the Stop-Go Arc 47. Every rotation cycle of the Timing Control Motor 21 and the Stop-Go Arc 47 will let one ball, and only one ball, to drop into the launch corridor through the Ball Guiding Manifold 16. When the Stop-Go Arc 47 is at its down position, no ball will drop. When the Stop-Go Arc 47 is at its up position, the Next Ball 32 will drop, and other balls will be blocked.

In FIG. 11, the Ball Collection Assembly 40 consists of the Slave Rod 26, the Guide Ring 27, the Funnel 36, and the Ball Entrance Duct 35. The Ball Collection Assembly 40 and the Ball Feeder Assembly 39 can be assembled in the field through the connection of the Ball Entrance Duct 35 to the Assembly Binding Body 34. With this assembly, the Slave Rod 26 is connected to the Pushrod 23 through the Stop-Go Slider 25 and is driven up and down. Or the Slave Rod 26 is just connected directly to the Pushrod 23. With the up and down movement, the Guide Ring 27 will push away any jam caused by multiple balls at the entry of the Ball Entrance Duct 35 and lead the most centered ball into the Ball Entrance Duct 35.

As shown in FIG. 1, the Launcher Assembly 1 is mounted on the Launcher Assembly Stand 2. The Launcher Assembly Stand 2 is secured on the Machine Platform 3 which is mounted on the Chassis Support 28. The Ball Feeder Assembly 39 and the Ball Collection Assembly 40 are mounted on the Launcher Assembly Stand 2. The complete machine is created.

Figure 12:
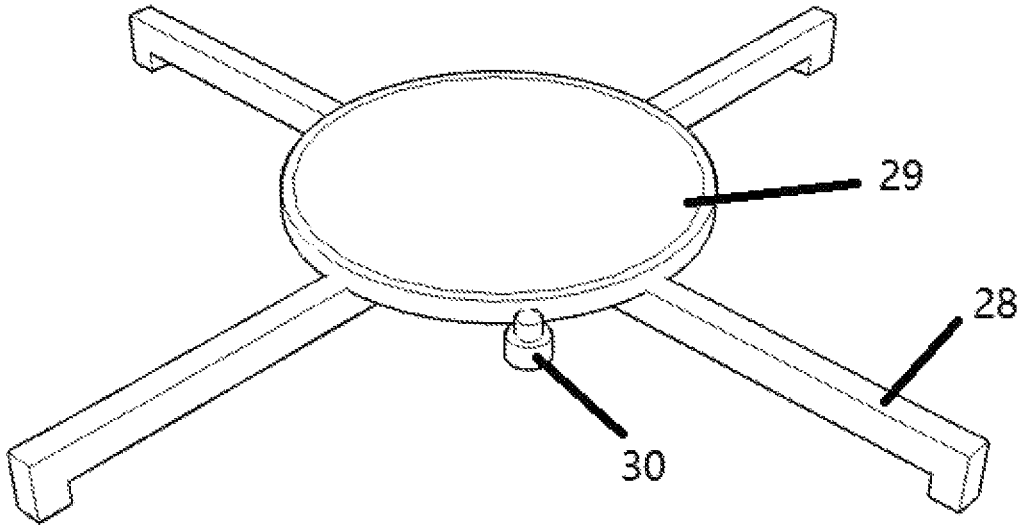
FIG. 12 shows the structure of the machine's platform on which the machine rotates horizontally.

In this embodiment, there is the Angle Adjustment Motor 31 on the Launcher Assembly Stand 2 to adjust the vertical angle of the Launcher Assembly 1. As shown in FIG. 12, the horizontal angle of the Launcher Assembly 1 is adjusted by the Turntable Motor 30 on the Machine Platform 3. The coordination between the Turntable Motor 30 and the Turntable 29 can be either a pinion to a gear wheel, a belt link or just friction wheels. The Turntable 29 pivots around the center of the Machine Platform 3.

In consideration of the portability and miniaturization, all modules and assemblies can be collapsible in the field. The whole disassembled machine can be fit into the back trunk of a car. In the same consideration, all electrical modules will be powered up with auto voltage level (12V or 24V). The unit can be powered by the in-unit battery or/and by a power core which directly goes to the car 12V socket or an AC adaptor.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed:

1. A sports ball training machine comprising:

a ball launcher assembly containing a launcher assembly frame and one or more propulsion modules to accelerate a ball through a launch corridor to the desired launch speed and eject it, to replicate the result of an athlete's action;

a set of two fixed mounting brackets, each attached at the bottom to a horizontal support platform and each attached at the top to support the ball launcher assembly while allowing same to pivot to any elevation angle;

a ball feeder assembly containing a plurality of balls released one-by-one in sequence;

connected to a support and vertical positioning assembly attached to each of the fixed mounting brackets and to a top-rear location of the ball launcher assembly, includes a ball-guiding manifold attached at its bottom to receive each said ball and deliver it to the ball launcher assembly;

and a ball collection assembly attached at the top of the ball feeder assembly, where a shape of the ball-guiding manifold together with operation of the support and vertical positioning assembly allow the ball feeder assembly and the ball collection assembly to remain in a vertical orientation angle for uniform and maximum gravity force while the ball launcher assembly pivots to any elevation angle but continuing to receive each said ball from the ball feeder assembly;

whereby the training efficiency of sports ball athletes is considerably enhanced.

2. The machine as in claim 1, wherein the support and vertical positioning assembly is comprised of a rigid and rigidly mounted frame-like subassembly, comprising:

a first set of two vertical sections of equal height, each attached at its bottom to one of the ball launcher assembly mounting brackets below the elevation-adjust pivot point, where each said first vertical section terminates at a height that is above the ball launcher assembly;

a first set of two identical horizontal sections, each a continuation of each said first vertical section, existing directly over the ball launcher assembly and extending about one quarter of the distance between the first vertical sections, a second set of two identical vertical sections, each a continuation of each said first horizontal section and extending upward for a distance about half the distance between the first vertical sections;

a second horizontal section, whose ends are attached to the tops of the second vertical section;

a movable interlinkage subassembly, comprising:

a multiplicity of horizontal rigid circular rings at spaced intervals surrounding the ball feeder;

a multiplicity of ganged parallel plates each having a hinge at each end, and each connected at one end to one of the said circular rings, where the hinge at the opposite end of each plate is attached horizontally between two of the second vertical sections;

a vertical pushrod connected through a set of spherical bearings at each plate and at its bottom to the launcher assembly;

whereby as the elevation angle of the launcher assembly varies, the feeder assembly remains in the vertical orientation.

3. The machine as in claim 1, wherein the ball launch corridor is formed by a belt-driven propulsion module above the ball and an extended ball feeder assembly ball-guiding manifold below the ball, where the ball launcher assembly is comprised of a ball launcher frame that helps to guide the ball and provides mounting to the mounting bracket and the belt-driven propulsion module, further comprising:

a closed loop belt having width about ⅓ the diameter of the ball to accelerate same;

a motorized belt-driving wheel powered by a variable speed motor at its ball receiving end and a non-motorized pulley wheel at its ball expelling end;

a framework forming the propulsion module structure consisting of two identical flat members, each of which attaches to one side of the motorized and non-motorized wheels;

a multiplicity of passive roller wheels spaced between the belt-driving wheel and the pulley wheel to support the ball, where each said roller, wheel and pulley are contoured to match a curvature of the ball, attached at each end to said framework flat members;

whereby the ball is ejected with the desired translational speed in accordance with that of the variable speed motor.

4. The machine as in claim 1, wherein the ball launch corridor is formed by belt-driven propulsion modules situated above and below the ball, and where the ball launcher assembly is comprised of a ball launcher frame that helps to guide the ball and provides mounting to the mounting bracket and the two said belt-driven propulsion modules, each further comprising:

a closed loop belt having width about ⅓ the diameter of the ball to accelerate same;

a motorized belt-driving wheel powered by a variable speed motor at its ball receiving end and a non-motorized pulley wheel at its ball expelling end;

a framework forming the propulsion module structure consisting of two identical flat members, each of which attaches to one side of the motorized and non-motorized wheels;

a multiplicity of passive roller wheels spaced between the belt-driving wheel and the pulley wheel to support the ball, where each said roller, wheel and pulley are contoured to match a curvature of the ball, and attached at each end to said framework flat members;

whereby the ball is ejected with the desired translational speed in accordance with that of the two variable speed motors and with a desired spin magnitude and direction in accordance with the differential speeds of said motors.

5. The machine as in claim 1, wherein the ball launch corridor is formed by a set of three belt-driven propulsion modules distributed around a circle, each spaced at 120 degrees, where the ball launcher assembly is comprised of a ball launcher frame that helps to guide the ball and provides mounting to the mounting bracket and the three said belt-driven propulsion modules, each further comprising:

a closed loop belt having width about ⅓ the diameter of the ball to accelerate same;

a motorized belt-driving wheel powered by a variable speed motor at its ball receiving end and a non-motorized pulley wheel at its ball expelling end;

a framework forming the propulsion module structure consisting of two identical flat members, each of which attaches to one side of the motorized and non-motorized wheels;

a multiplicity of passive roller wheels spaced between the belt-driving wheel and the pulley wheel to support the ball, where each said roller, wheel and pulley are contoured to match a curvature of the ball, and attached at each end to said framework flat members;

whereby the ball is ejected with the desired translational speed in accordance with that of the three variable speed motors and with the desired spin magnitude and direction in accordance with the differential speeds of said motors.

6. A sports training machine ball launcher assembly consisting of a tension belt-driven propulsion module comprising:

a closed loop belt having width about half the diameter of the ball to accelerate the ball;

a motorized belt-driving wheel powered by a variable speed motor at its ball expelling end and a non-motorized pulley wheel at its ball receiving end, where a length of the belt considerably exceeds that needed to cover the distance between the motorized and non-motorized driving wheels, thus creating a slack condition;

a framework forming the tension belt driven module structure consisting of two identical flat members, each of which attaches to one side of the driving and the pulley wheels, where the shape of said members is contained within the perimeter of the belt, and biased to create a large clearance between the framework and the belt span that carries and accelerates the ball;

a tensioning mechanism contained within the framework wherein midway between the driving wheel and the pulley wheel, each said flat member has a slot that is perpendicular to the belt surfaces;

a tension pulley connects the two slots and rides within them, and the tension pulley is inside the belt perimeter and is spring-loaded in a direction to maintain tension on the belt, thus dynamically removing the slack condition created by the additional belt length that is not taken up by the weight of the ball as it is carried by the top of the belt surface, and automatically guiding the ball to follow a dipping arc path in the vertical plane;

whereby the ball's contact with the belt is prolonged, allowing extended time to accelerate, and conservation of the ball's consequent curved path angular momentum together with its centrifugal reaction force on the belt keeps it on the same;

a ring subassembly structure comprising:

a circular frame structure that is mounted on the launching assembly at the ball ejection end of the belt-driven propulsion module, is oriented so its axis is parallel to the motion of the ball, has a diameter larger than necessary for the ball to pass through, and supports a multiplicity of motorized ball griping wheels, which are distributed at several locations around the circular frame structure, make contact with and grip the ball as it passes through the frame, assist with acceleration of the ball, and cause the ball to have the desired spin magnitude and direction;

whereby the ball is ejected with the desired translational speed in accordance with that of the variable speed motor and motorized spinning wheels, and with the desired spin angular momentum in accordance with the differential speeds of the motorized spinning wheels.

7. A combination ball delivery gate component and anti-jam component subassembly contained within a ball feeder assembly and a ball collection assembly of a sports ball training machine; where the ball collection assembly receives and stores a multiplicity of balls and delivers them as space appears one at a time via gravity-feed to a cylindrically shaped feeder assembly as aided by the anti-jam component;

the feeder assembly holds a multiplicity of balls in a vertical array and delivers them when needed one at a time to a ball launcher assembly as aided by the delivery gate component, the combination ball delivery gate component and anti-jam component subassembly comprising:

a control motor horizontally mounted just below the bottom of the feeder assembly that rotates a disk whose axis is also horizontal;

a vertical pushrod whose lower end is attached near an edge of the disk with a floating pin, where the top of the pushrod is in the collection assembly and is attached to the edge of a horizontally placed circular guide ring whose diameter exceeds that of the ball but is less than 50% larger than same, the guide ring selects a ball each time the pushrod is ascending, thereby preventing a jam, and at a location of the pushrod close to the bottom of feeder assembly, it is attached to a ball delivery gate component, formed to be shaped like the arc of a vertically placed circle, such that the gate is closed when the pushrod is at its lowest point and open when the pushrod is in its highest point;

whereby the combination ball delivery gate component and anti-jam component subassembly releases a ball from the feeder assembly to the ball launching assembly at time intervals in accordance with the control motor speed while simultaneously selecting a replacement ball from the feeder assembly.

8. The combination ball delivery gate component and anti-jam component subassembly as in claim 7, wherein the ball delivery gate component, attached to the pushrod at a location close to the bottom of the feeder assembly, is comprised of a rectangularly shaped flat stock whose length is about ¼ the circumference of the ball, formed to be shaped like the 90-degree arc of a vertically oriented circle with diameter equal to that of the ball, where the formed flat stock is placed in a vertical orientation just inside the feeder assembly with its concave direction facing the feeder assembly's central axis, slides in a vertical direction inside of a clasp that is rigidly fastened to the ball feeder's outer structure, includes a rigidly attached lever protruding perpendicularly from its convex surface that is controlled by the pushrod to slide, where a lowest ball in the feeder assembly is resting on the concave surface of the ball delivery gate's lower portion when the pushrod and lever are at their lowest point;

as the pushrod and lever ascend, the lowest ball is gradually released while the top portion of the gate's curved surface protrudes to be between the lowest ball and a next lowest ball, thus preventing same from falling any further until it becomes the lowest ball and rests on the concave surface of the delivery gate's lower portion when the pushrod is again at its lowest position;

whereby the pushrod moves from its lowest position to its highest position and back to operate the combination ball delivery gate component and anti-jam component to deliver a ball from the feeder assembly to the ball launching assembly at time intervals in accordance with the control motor speed, while simultaneously selecting a replacement ball from the feeder assembly.

* * * * *